US012378746B2

(12) United States Patent
Widmann et al.

(10) Patent No.: US 12,378,746 B2
(45) Date of Patent: Aug. 5, 2025

(54) CUTTING WHEEL ASSEMBLY FOR A SLURRY WALL CUTTER

(71) Applicant: Liebherr-Components Biberach GmbH, Biberach an der Riss (DE)

(72) Inventors: Roland Widmann, Unlingen (DE); Johannes Halder, Ertingen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 1036 days.

(21) Appl. No.: 17/444,509

(22) Filed: Aug. 5, 2021

(65) Prior Publication Data

US 2022/0064897 A1 Mar. 3, 2022

Related U.S. Application Data

(63) Continuation of application No. PCT/EP2020/054342, filed on Feb. 19, 2020.

(30) Foreign Application Priority Data

Feb. 21, 2019 (DE) ..... 20 2019 101 004.5
Apr. 30, 2019 (DE) ..... 20 2019 102 438.0

(51) Int. Cl.
*E02F 3/20* (2006.01)
*E02D 17/13* (2006.01)
(Continued)

(52) U.S. Cl.
CPC ..... *E02F 3/241* (2013.01); *E02D 17/13* (2013.01); *E02F 3/188* (2013.01); *E02F 5/08* (2013.01)

(58) Field of Classification Search
CPC ... E02F 5/08; E02F 3/241; E02F 3/188; E02F 3/246; E02F 3/26; E02F 3/205; E02D 17/13
See application file for complete search history.

(56) References Cited

U.S. PATENT DOCUMENTS 2,592,382 A * 4/1952 Blais ..... B27G 13/007 144/237
6,193,320 B1 2/2001 Weiss
(Continued)

FOREIGN PATENT DOCUMENTS

CN 101132934 2/2008
CN 103306324 9/2013
(Continued)

*Primary Examiner* — Joseph M Rocca
*Assistant Examiner* — Robert E Pezzuto
(74) *Attorney, Agent, or Firm* — Levine Bagade Han LLP

(57) ABSTRACT

The present invention relates in general to slurry wall cutters for cutting slurry walls in specialist foundation engineering. The invention relates in particular to the cutting wheel assembly for such a slurry wall cutter (1), comprising a rotationally drivable cutter hub (8) and a cutting wheel (3) which can be detachably fastened to the cutter hub for conjoint rotation. According to the invention, the cutting wheel and the cutter hub are clamped against one another at the end faces thereof and are interlockingly secured to one another in order to transmit the high operating forces non-frictionally or at least not only frictionally. According to the invention, the end faces of the cutting wheel and the cutter hub that can be placed against one another are provided with lateral teeth (16, 17) which mesh with one another for conjoint rotation. The meshing pair of lateral teeth allows the cutter hub and the cutting wheel to be interlockingly held relative to one another for conjoint rotation. At the same time, the end faces lying against one another can also transmit axial forces such that the cutting wheel is untiltably held in place.

17 Claims, 5 Drawing Sheets

(51) Int. Cl.

| | |
|---|---|
| ***E02F 3/18*** | (2006.01) |
| ***E02F 3/24*** | (2006.01) |
| ***E02F 5/08*** | (2006.01) |

(56) References Cited

U.S. PATENT DOCUMENTS

| | | | | |
|---|---|---|---|---|
| 10,517,235 | B2 * | 12/2019 | Casper | A01G 23/067 |
| 11,603,887 | B2 * | 3/2023 | Kuckhoff | F16D 1/033 |
| 2022/0064897 | A1 * | 3/2022 | Widmann | E02D 17/13 |
| 2022/0186456 | A1 * | 6/2022 | Geiger | E02F 5/08 |

FOREIGN PATENT DOCUMENTS

| | | | | |
|---|---|---|---|---|
| EP | 378485 | A * | 7/1990 | E02F 3/22 |
| EP | 0841467 | | 5/1998 | |
| EP | 1975323 | | 10/2008 | |
| EP | 2597205 | A1 * | 5/2013 | E02D 17/13 |
| EP | 2597205 | | 4/2014 | |
| JP | H04-097019 | | 3/1992 | |
| JP | 2002-161532 | | 6/2002 | |
| JP | 2008-240511 | | 10/2008 | |
| JP | 2018-204187 | | 12/2018 | |
| WO | WO 2020/169657 | | 8/2020 | |

* cited by examiner

CUTTING WHEEL ASSEMBLY FOR A SLURRY WALL CUTTER

CROSS-REFERENCE TO RELATED APPLICATIONS

This application is a continuation of International Patent Application Number PCT/EP2020/054342 filed Feb. 19, 2020, which claims priority to German Patent Application Numbers DE 20 2019 101 004.5 filed Feb. 21, 2019 and DE 20 2019 102 438.0 filed Apr. 30, 2019, the contents of which are incorporated herein by reference in their entireties.

BACKGROUND

The present invention generally relates to slurry wall cutters for cutting slurry walls in special civil engineering. The invention here in particular relates to the cutting wheel assembly for such a slurry wall cutter having a rotatingly drivable cutter hub and a cutting wheel that is rotationally fixedly releasably fastenable to the cutter hub.

Slurry wall cutters are as a rule used in special civil engineering to cut trenches in the soil, rock, or subsoil that are filled with a suspension comprising, for example, concrete to form a slurry wall. Slurry walls are generally wall constructions in the subsoil composed of e.g. concrete, reinforced concrete, and the like. To produce such a slurry wall, a substantially vertical trench that is open to the top is cut using a slurry wall cutter, with the cutting tool being lowered into the soil from above and being guided by a support unit, such as a crawler excavator that is supported on the ground and that is preferably travelable. The slurry wall cutter here typically comprises an elongate, upright cutting frame that is vertically travelably suspended at the support unit and that typically supports a plurality of cutting wheels at its lower end that can be drivable in opposite directions about respective horizontal axes. The drive for the rotary driving of the cutting wheels can likewise be supported at a lower section of the cutting frame and can, for example, comprise one or more hydraulic motors that can drive the cutting wheels, for example, via a chain drive and/or one or more gear stages.

The cutting wheels of such a slurry wall cutter here have to be replaced regularly and relatively frequently. On the one hand, the cutting tools that are arranged at the circumferential side at the cutting wheels are subject to great wear. In order not to have to replace the large number of cutting bits individually, the total cutting wheel is usually removed and replaced with a different cutting wheel having fresh cutting bits. On the other hand, however, different, respectively optimized cutting wheels are also used for different soil properties. Since the soil properties can vary in dependence on the cutting depth, the cutting wheels are also often replaced during the cutting of a single trench if the soil properties do not change as the cutting depth increases. Different cutting wheels are furthermore also used for different trench widths and trench depths so that the cutting wheels of a slurry wall cutter have to be replaced very frequently overall.

To lose as little time as possible for the changing of the cutting wheels on a construction site and to have the lowest possible downtimes of the machine, it is desirable to make the replacement process as simple as possible. As a rule, the cutting wheels of a slurry wall cutter are fixedly clamped to the cutter hub by friction. To be able to transfer the very high forces and torques in cutting operation between the cutting wheel and the cutter hub, a very large number of screws, for example 48 screws per cutting wheel, are typically used by means of which the respective cutting wheel is clamped by friction against the cutter hub. To achieve a uniform clamping, all the threaded bolts have to be tightened with the same torque, for example by means of a torque wrench, so that the sum of the preload forces of the screws clamps the cutting wheels at the cutter hub and holds them fast by friction. It is, however, disadvantageous here that all the screws have to be released and subsequently mounted again with a uniform torque tightening on a cutting wheel change, which is very complex and time-intensive.

To reduce this time effort for the cutting wheel replacement, it has already been proposed to provide a kind of bayonet fitting between the cutter hub and the cutting wheel, cf. EP 2 597 205 B 1. Slit-shaped cutouts are here provided at the cutter hub distributed over the circumference that are open toward one side so that suitably formed projections provided at the cutting wheel are pushable into the pocket-shaped cutouts and are lockable by rotation. In this respect, the projections and the pocket-shaped cutouts are each formed in wedge shape so that they clamp against one another when the cutting wheel is rotated with respect to the hub. However, said clamping and a force transfer can only be achieved in one rotational direction with the bayonet fitting type of connection. If the cutting wheels are rotated backward, an unwanted release of the bayonet-like clamping connection occurs.

To avoid this rotational direction problem, it has also already been considered to form the cutter hub in the manner of a hexagon and to provide a complementary cutout, likewise hexagonal, at the cutting wheel that can be pushed onto the hexagonal contour of the hub. Such a polygonal end connection typically has to be formed with clearance, however, to enable a simple assembly and disassembly, which then, however, produces corresponding wear in operation. In addition, forces can per se only be transferred in a radial direction, but not in an axial direction so that additional clamping or tensioning means have to be provided to be able to remove the axial forces also occurring in operation.

It is therefore the underlying object of the present invention to provide an improved slurry wall cutter and an improved cutting wheel assembly that avoid disadvantages of the prior art and further develop the latter in an advantageous manner. A cutting wheel fastening should in particular be provided that can be assembled and disassembled simply and quickly and that can transfer the forces and torques occurring in operation in as wear-free a manner as possible.

SUMMARY

In accordance with the invention, said object is achieved by a cutting wheel assembly in accordance with claim 1 and by a slurry wall cutter in accordance with claim 17. Preferred embodiments of the invention are the subject of the dependent claims.

It is therefore proposed to clamp the cutting wheel and the cutter hub against one another at the end face and to fix them against one another by shape matching in order not to transfer the high operating forces or at least not only to transfer them by friction. In accordance with the invention, the end faces of the cutting wheel and the cutter hub that can be placed on one another are provided with end toothed arrangements that rotationally fixedly engage in one another. The cutter hub and the cutting wheel are held rotationally fixedly by shape matching relative to one another by the end toothed arrangement pair engaging into one another. At the same time, the end faces seated on one another can also transfer axial forces so that the cutting wheel is held in a tilt resistant manner. Since the operating forces and torques are transferred by shape matching by the toothed arrangement engagement, the cutting wheel can be secured in a relatively simple manner, for example by some few screws, at the cutter hub so that the time effort for the disassembly or assembly can be considerably reduced.

The end toothed arrangements engaging into one another at the end faces of the cutting wheel and the cutter hub can in particular form a clearance-free shape matching connection that prevents micromovements due its freedom from clearance and thus dramatically reduces wear. At the same time, the cutting wheel and the cutter hub can be assembled or disassembled by a one-dimensional movement, in particular by a simple pushing onto one another at the end face, without an additional rotation or threading movement being necessary as with a bayonet fitting.

In general, it could, however, also be considered to configure the end toothed arrangement state with a little clearance. In a further development of the invention, a centration or a centration device can be provided, for example attached to the hub pot, to transfer additional radial forces and to relieve the end toothed arrangement.

To secure the cutting hub and the cutting wheel at one another in the axial direction and/or at the end face or to tension them against one another, axially active clamping means can be provided between the cutting wheel and the cutting hub that pull and/or press the cutting hub against the cutting hub in the direction of the axis of rotation. Such axial clamping means can generally be configured as different, for example can have a central closure, for example in the form of a central screw cap. Alternatively or additionally, some few threaded bolts can be provided distributed over the circumference to tension the cutting wheel toward the cutting hub and/or clamp it tight thereat. Said threaded bolts can advantageously be arranged distributed along a partial circle passing through the end toothed arrangement. The threaded bolts can in particular be provided in the region of mutually engaging end toothed arrangement sections to also ensure the exactly fitting engagement of the toothed arrangements into one another under operating forces.

The end toothed arrangement stages engaging into one another can generally be configured differently, for example can have a peripheral end toothed arrangement at every end face closed in an annular manner. In an advantageous further development of the invention, however, the end toothed arrangements at the end faces of the cutting hub and of the cutting wheel can advantageously each have a plurality of mutually spaced apart tooth groups that can be arranged distributed over the circumference spaced apart from one another. Tooth groups and surfaces free of toothed arrangements can alternate viewed in the circumferential direction, for example.

At least three such tooth groups and at most ten such tooth groups can advantageously be provided, with four to eight or in particular six tooth groups being able to arranged distributed over the circumference. Alternatively, however, only one tooth group can also be provided that can be distributed completely over the circumference.

The teeth of the toothed arrangements can here have different contours and/or profiles. To be able to transfer torques and also radial and axial forces equally, it can be advantageous if the teeth within each tooth group are arranged or aligned in parallel with one another, but the different tooth groups are arranged rotated with respect to one another with regard to the orientation of their teeth.

Provision can be made in an advantageous further development of the invention that the teeth each have a straight tooth flank progression and that the teeth of each tooth group are arranged in parallel with one another. If the tip of a respective tooth is considered, the burr forming the tip can have a straight progression. It would generally be conceivable that the teeth have a curved progression. The teeth can, however, advantageously each have a straight progression when viewing their tips or burrs and valleys disposed between the teeth.

The respective tooth groups can in particular have one tooth that extends in a radial direction while the remaining teeth can extend in parallel therewith and thus offset transversely to the radial direction. A middle tooth of a respective tooth group can in particular extend in the radial direction and be flanked to the right and to the left by teeth aligned in parallel therewith.

Said tooth groups can here have a different number of teeth, for example between three and ten teeth, can in particular comprise approximately six to eight teeth, with all the tooth groups being able to have the same number of teeth.

In a further development of the invention, the tooth groups can also be arranged or configured as asymmetrical overall, for example in that one tooth group has a smaller number of teeth than the other tooth groups. It can hereby be ensured that the cutting wheel fits on the cutting hub in only one predetermined rotational position. Alternatively or additionally, a predetermined rotary assembly position of the cutting wheel can, however, also be achieved by a corresponding arrangement of the threaded bolts, for example by an uneven distribution in the circumferential direction, for example by an additional threaded bolt with an otherwise uniform division pattern.

The desired rotational position relative to one another can in particular be ensured with a plurality of cutting wheels by such a clear fixing of the rotary assembly position of the cutting wheel on the associated cutter hub to ensure a synchronous revolution or engaging into one another of the cutting tools. The cutting wheels can in particular be aligned with one another such that cutting bits that project at the circumferential side do not collide with one another even if the cutting wheels are arranged very close to one another.

The teeth of the end toothed arrangement stage can generally have different profiles, with the teeth advantageously being able to be formed by a respective tooth profile, viewed in cross-section, as symmetrical with a sectional plane of a parallel axis of rotation to be able to transfer forces evenly in both rotational directions.

Viewed in cross-section, the teeth can in particular each be contoured as frustoconical and/or can have straight or planar tooth flanks. Such teeth contoured in wedge shape can, for example, be contoured at a wedge angle of 2 times 10° to 2 times 40° or 2 times 15° to 2 times 30° or in particular approximately 2 times 20°. At a wedge angle in the range from 2 times 15° to 2 times 25°, a clearance-free engagement into one another can be ensured, on the one hand, and an excessive clamping while tightening can be prevented, on the other hand.

The teeth can here be flattened at their acute planes. The valleys between two teeth or the respective dedenda can advantageously be contoured as rounded, viewed in cross-section, to avoid tension peaks in the tooth base.

BRIEF DESCRIPTION OF THE DRAWINGS

The invention will be explained in more detail in the following with reference to a preferred embodiment and to associated drawings. There are shown in the drawings.

DETAILED DESCRIPTION

Figure 1:
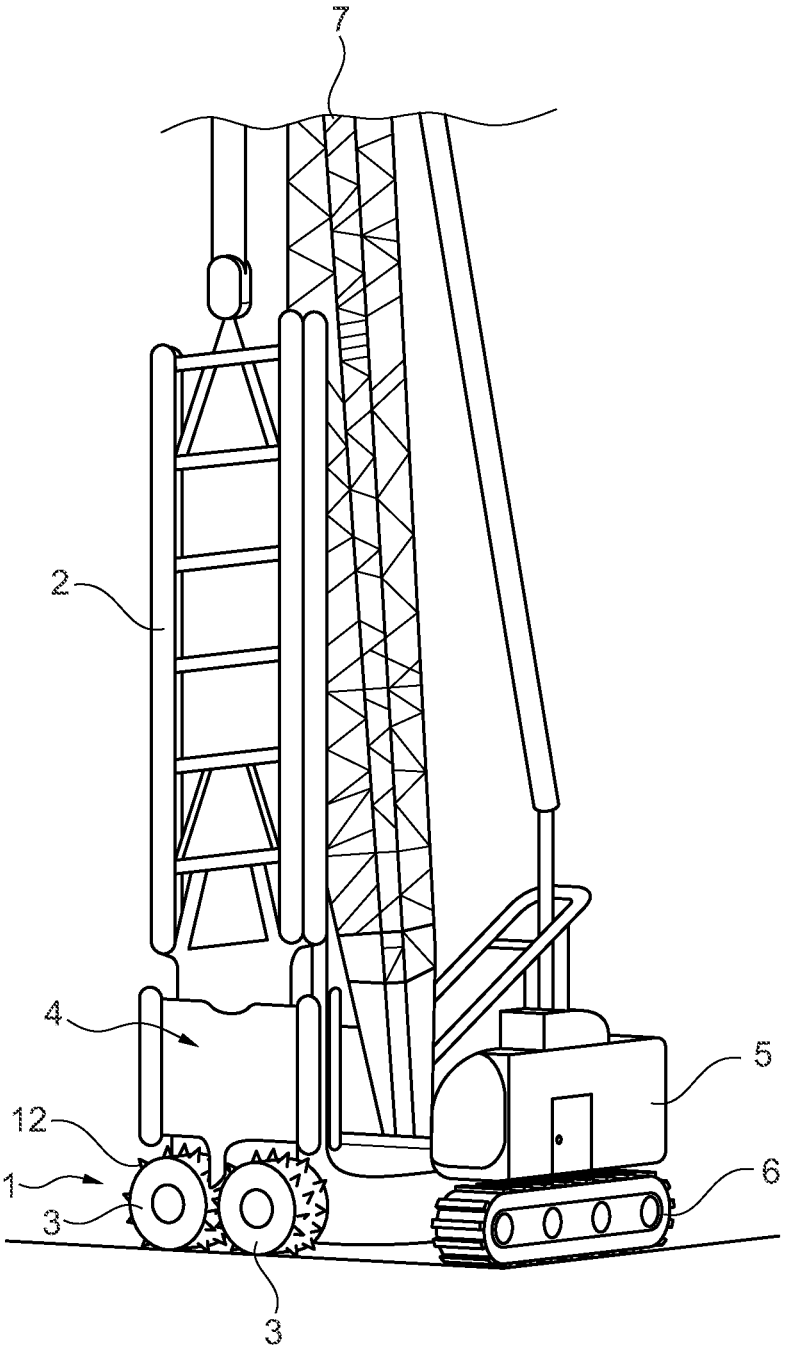
FIG. 1: a schematic, perspective representation of a slurry wall cutter in accordance with an advantageous embodiment of the invention.
Figure 2:
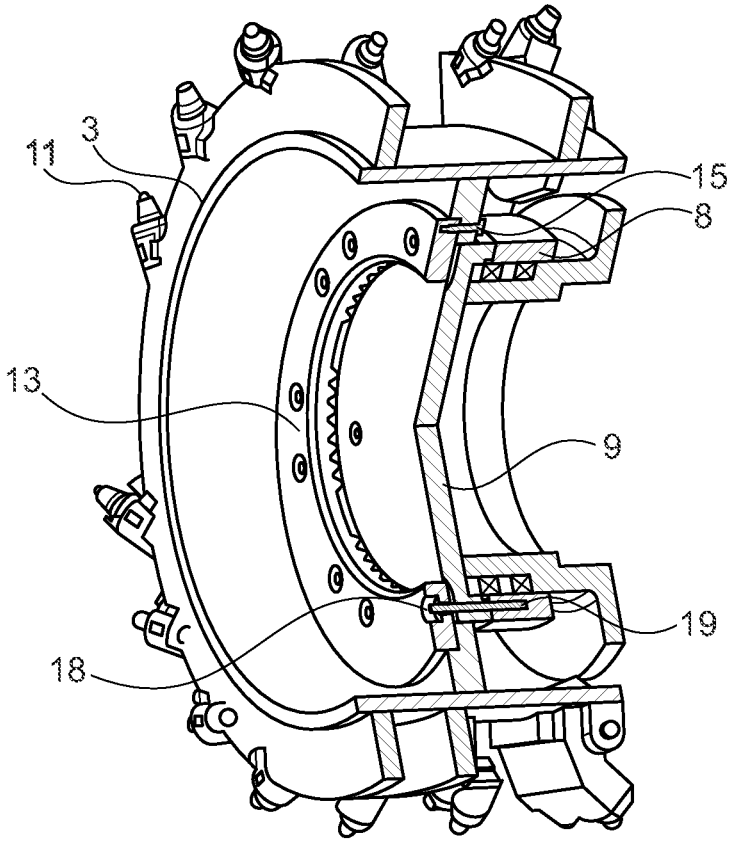
FIG. 2: a perspective, partially sectional representation of a cutting wheel and of a cutter hub of the slurry wall cutter of the preceding Figure, with the cutter hub and the cutting wheels being shown in the state mounted at one another.

As FIG. 1 shows, the slurry wall cutter 1 can have an elongate cutting frame 2 arranged as upright that can be configured as a lattice carrier and/or can comprise two laterally arranged longitudinal guide sections. The cutting frame 2 can have at least two cutting wheels 3 at a lower end section, said cutting wheels 3 being arranged next to one another and being able to be rotarily drivable about respective horizontal axes of rotation, with the axes of rotation of the cutting wheels 3 being able to extend in parallel with one another in particular perpendicular to the flat side of the cutting frame 2.

The two cutting wheels 3 can here be driven oppositely to one another. A cutting drive 4 can be arranged above the cutting wheels 3 at a lower end section of the cutting frame 2 and can, for example, comprise one or more hydraulic motors that can drive said cutting wheels 3 via one or more transmission stages.

As FIG. 1 shows, the cutting frame 2 with the cutting wheels 3 can be held raisably and lowerably by a support unit 5 or can be suspended thereat. Said carrier support unit 5 stands on the ground in which the respective trench should be cut and can advantageously be configured as travelable. A cable excavator having a chassis, for example a tracked chassis 6, can in particular be provided as the support unit 5, with the cutting frame 2 being able to be raised and lowered by a boom 7 of the support unit 5.

As FIGS. 2 to 5 show, each cutting wheel 3 is fastened to a cutter hub 8 that is rotatably supported at the cutting frame 2 and is drivable by the cutting drive 4. The cutter hub 8 can here be formed by the output element of the cutter drive 4 or by an interposed transmission stage. Said transmission stage can in particular be configured as a planetary gear, with the cutter hub 8 being able to be formed, for example, by a planetary carrier of the planetary gear.

The cutter hub 8 can in particular have a rotatably supported hub pot 9 that can have an end face 10 that is formed as planar, for example, and against which the cutting wheel 3 can be tensioned.

The cutting wheel 3 can be set up in the manner of a rim and can independently thereof have a circumferential wall 11 at whose outer side one or more rows of cutting tools 12, for example in the form of cutting bits, can be arranged. Said circumferential wall 11 is rigidly connected to a fastening flange 13 that can be formed as a plate or ring and that independently thereof has an end face 14 that is placeable against the end face 10 of the cutter hub 8. Said fastening flange 13 can extend approximately in a plane perpendicular to the axis of rotation and have a flat end face 14 that faces the cutter hub 8.

Said fastening flange 13 is advantageously releasably fastened to the remaining body of the cutter wheel 3 to be able to be replaced on wear. The fastening flange 13 can, for example, be fastened to the body of the cutting wheels 3 by means of a plurality of screws 15.

Figure 3:
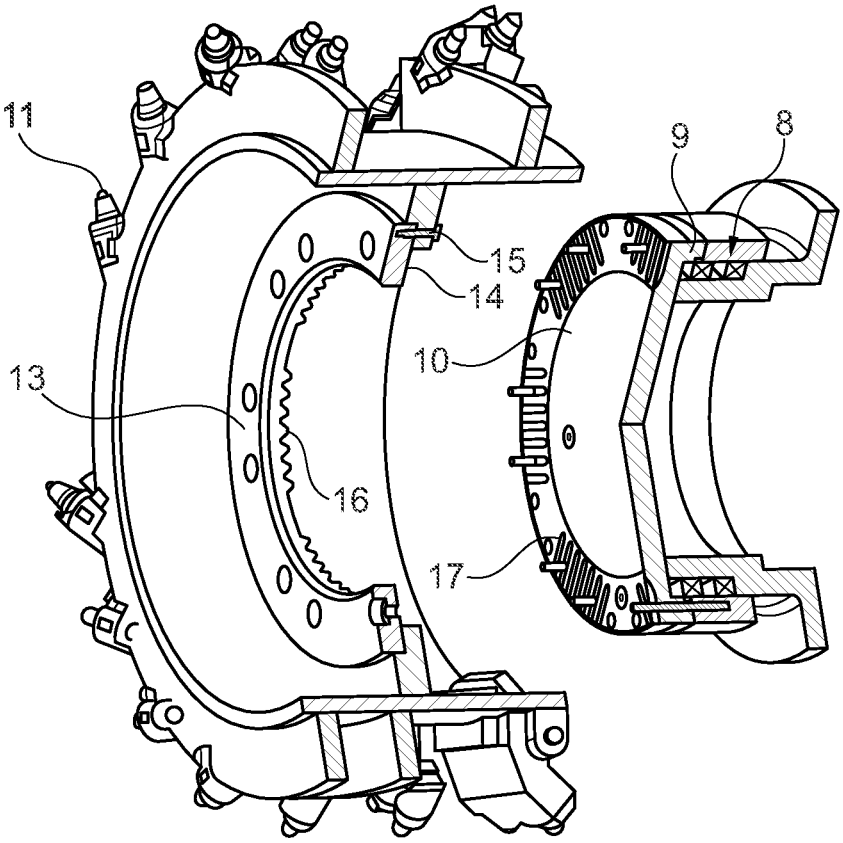
FIG. 3: a perspective, partially sectional representation of the cutting wheel and of the cutter hub similar to FIG. 2, with the cutting wheel and the cutter hub being shown in the state disassembled from one another.
Figure 4:
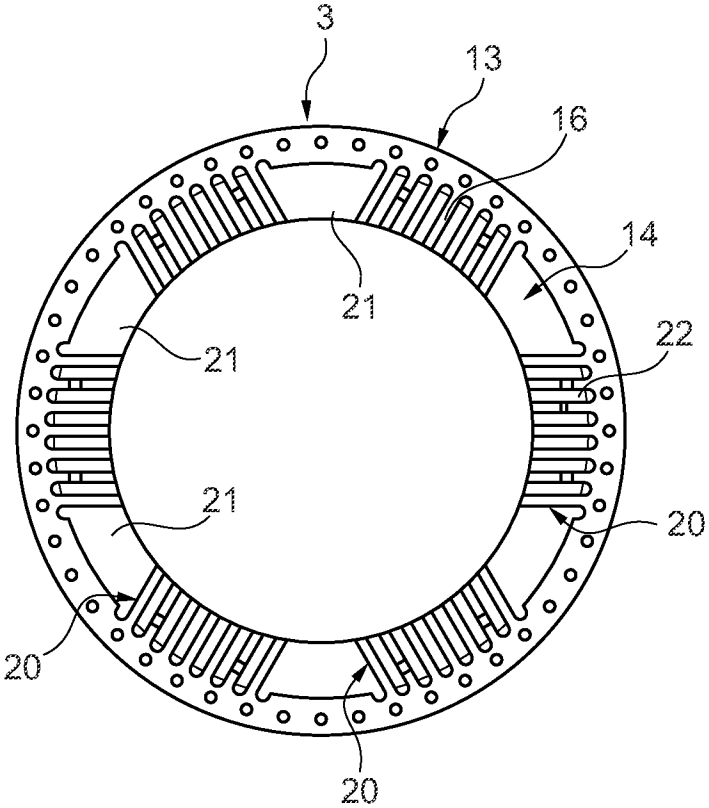
FIG. 4: a plan view of the end faces of the cutting wheel and of the cutter hub of the preceding Figures that are end faces each having an end toothed arrangement.
Figure 4:
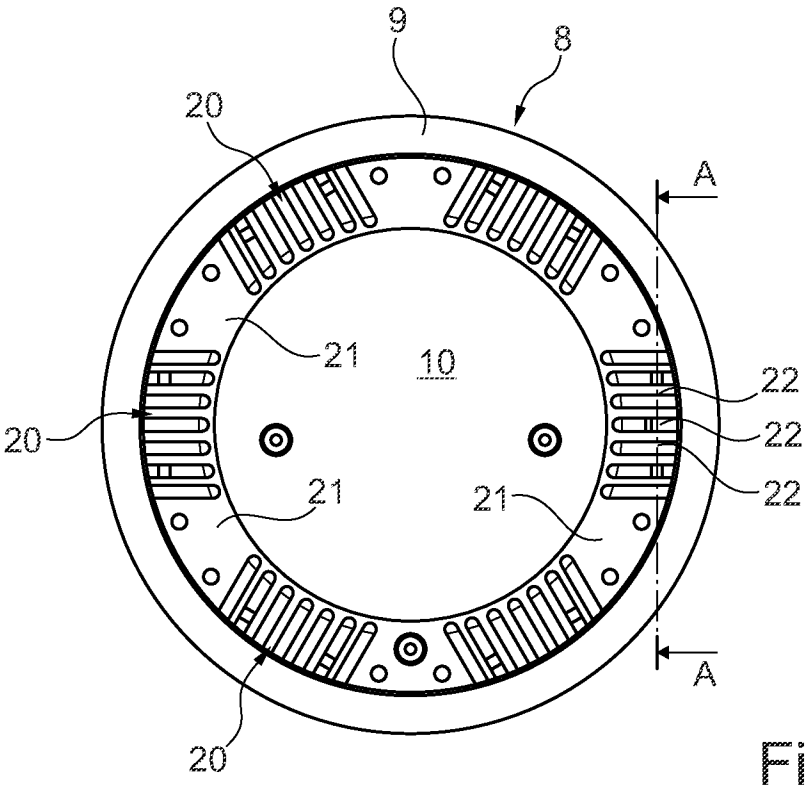
Figure 5:
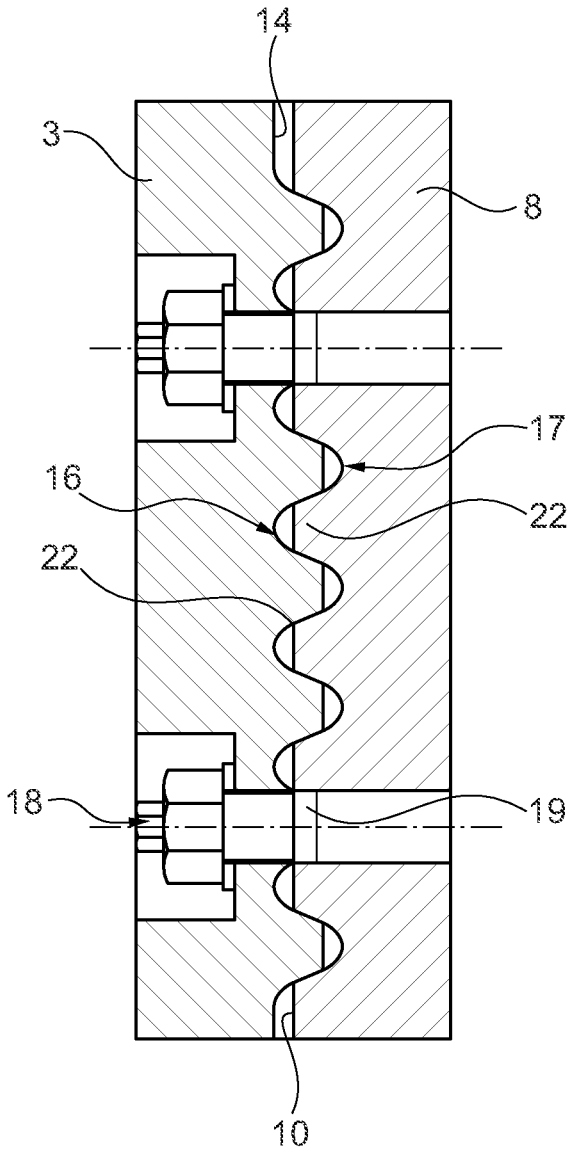
FIG. 5: a partially sectional view along the line A-A in FIG. 4 which shows the mutually engaging end toothed arrangements of the cutter hub and cutting wheel.

As FIGS. 3, 4, and 5 show, the end faces 10 and 14 of the cutter hub 8 and of the cutting wheel 3 that can be placed at one another are each provided with an end toothed arrangement 16, 17 that are formed matching one another in a shape matched manner and that are arranged such that the two end toothed arrangements 16 and 17 come into tooth engagement with one another when the end faces 10 and 14 of the cutter hub 8 and of the cutting wheel 3 are placed onto one another. The end toothed arrangements 16 and 17 are here configured such that they come into engagement with one another by a simple axial pushing onto one another of the cutting wheel 3 and the cutter hub 8 in parallel with the axis of rotation. If the two end toothed arrangements 16 and 17 are seated on one another so that they engage into one another, as FIG. 5 shows, the cutting wheel 3 is fixed to the cutter hub 8 with shape matching and rotational fixation.

The cutting wheel 3 can here be axially tensionable against the cutter hub 8 by axial tensioning means 18, that can advantageously comprise a plurality of threaded bolts 19, to secure the cutting wheel 3 on the cutter hub 8 and to hold the end toothed arrangements 16 and 17 in engagement by shape matching. As FIG. 3 shows, a plurality of threaded bolts 19 can be arranged distributed in the circumferential direction, can in particular be provided in the region of the end toothed arrangements 16 and 17, to fix the end toothed arrangements 16 and 17 uniformly in the engagement position.

As FIG. 4 shows, the end toothed arrangements 16 and 17 can each have a plurality of tooth groups 20—6 in the embodiment drawn—that can be arranged spaced apart from one another and evenly distributed, optionally also unevenly distributed, in the circumferential direction. The tooth groups 20 can in particular be arranged on a common partial circle and can each be separated from one another by toothed arrangement-free surfaces 21.

As FIG. 4 shows, each tooth group 20 can have a plurality of teeth 22 hat can each have tooth flanks extending as straight, with all the tooth flanks of a tooth group being able to be arranged in parallel with one another, while the tooth groups 20 can be rotated relative to one another or can be aligned in different directions. A respective middle tooth of a respective tooth group 20 can in particular extend in the radial direction with respect to the axis of rotation and can be respectively flanked to the right and to the left by teeth aligned in parallel therewith.

As FIG. 5 shows, the teeth 22 of the end toothed arrangements 16 and 17 can each be contoured as frustoconical, viewed in cross-section, with the tooth flanks of the frustoconical teeth 22 being able to extend at a wedge angle of, for example, 2 times 20°.

The teeth 22 can be truncated in a flat or planar manner in the region of the tooth tips. Independently thereof, the valleys between the teeth 22 or the dedendum regions can be rounded, cf. FIG. 5.

We claim:

1. A cutting wheel assembly for a slurry wall cutter having a cutter hub and a cutting wheel that is releasably fastened to the cutter hub in a rotationally fixed manner, wherein the cutter hub is rotatingly drivable, wherein an end face of the cutter hub and an end face of the cutting wheel are placeable against one another via axial clampers, wherein the axial clampers are configured for axial tensioning of the end face of the cutting wheel and the end face of the cutter hub against one another, wherein the end face of the cutter hub and the end face of the cutting wheel have shape matched connectors that are rotationally fixedly engageable with one another, wherein the shape matched connectors comprise end toothed arrangements, and wherein the end toothed arrangements of the cutter hub and the cutting wheel each have tooth groups arranged in a circumferential direction spaced apart from one another.

2. The cutting wheel assembly of claim 1, wherein the end face of the cutter hub and the end face of the cutting wheel have surfaces free of toothed arrangements between the shape matched connectors.

3. The cutting wheel assembly of claim 1, wherein the axial clampers comprise screws and/or threaded bolts that are arranged along a partial circle passing through the end toothed arrangements.

4. The cutting wheel assembly of claim 1, wherein each of the tooth groups has teeth, wherein the teeth of each of the tooth groups are aligned parallel with one another, and wherein the tooth groups are arranged rotated relative to one another such that the teeth of different tooth groups extend inclined at an acute angle with respect to one another.

5. The cutting wheel assembly of claim 3, wherein the end toothed arrangements have straight teeth having tooth tips that define a straight extent.

6. The cutting wheel assembly of claim 1, wherein a middle tooth of at least one of the tooth groups is arranged radially to an axis of rotation of the cutter hub and of the cutting wheel, and wherein all the other teeth of the at least one of the tooth groups are arranged parallel to the axis of rotation.

7. The cutting wheel assembly of claim 4, wherein the teeth are each frustoconically contoured when viewed in cross-section.

8. The cutting wheel assembly of claim 4, wherein the teeth have planar tooth flanks and/or have straight tooth flanks when viewed in cross-section that are set at a wedge angle in the range of 2 times 50°, 2 times 15°, or 2 times 40° to 2 times 25°.

9. The cutting wheel assembly of claim 3, further comprising a fastening flange releasably fastened to a cutting wheel body that supports cutting tools, and wherein the fastening flange comprises the end toothed arrangement of the cutting wheel.

10. The cutting wheel assembly of claim 3, wherein a hub plate or a hub flange comprises the end toothed arrangement of the cutter hub, and wherein the hub plate or the hub flange is releasably fastened to a hub pot.

11. The cutting wheel assembly of claim 3, wherein the end toothed arrangements are configured such that the cutting wheel is fastenable to the cutter hub in a maximum of six different rotary positions, or a maximum of two different rotary positions, or a maximum of only one rotary position relative to the cutter hub.

12. The cutting wheel assembly of claim 3, wherein force and/or torque is transmittable equally in two opposite directions of rotation by the end toothed arrangements.

13. The cutting wheel assembly of claim 1, wherein an output part of a transmission stage comprises the cutter hub, and wherein the cutting wheel is connected to a cutting drive in a torque transmittable manner via the output part of the transmission stage.

14. The cutting wheel assembly of claim 13, wherein the transmission stage comprises a planetary gear, and wherein a planetary carrier of the planetary gear comprises the cutter hub.

15. A slurry wall cutter having the cutting wheel assembly of claim 1.

16. The slurry wall cutter of claim 15, wherein the cutting wheel and the cutter hub are supported at an elongate upright cutting frame that supports a cutting drive and is suspended at a movable support unit standing on the ground.

17. The cutting wheel assembly of claim 13, wherein the cutter hub comprises a hub pot.

* * * * *